US010008187B2

(12) United States Patent
Doering

(10) Patent No.: US 10,008,187 B2
(45) Date of Patent: Jun. 26, 2018

(54) SYSTEMS, DEVICES, AND/OR METHODS FOR PERCUSSION INSTRUMENTS

(71) Applicant: Micah Doering, Post Falls, ID (US)

(72) Inventor: Micah Doering, Post Falls, ID (US)

( * ) Notice: Subject to any disclaimer, the term of this patent is extended or adjusted under 35 U.S.C. 154(b) by 66 days.

(21) Appl. No.: 15/481,622

(22) Filed: Apr. 7, 2017

(65) Prior Publication Data

US 2018/0102116 A1 Apr. 12, 2018

Related U.S. Application Data

(60) Provisional application No. 62/406,904, filed on Oct. 11, 2016.

(51) Int. Cl.
*G10D 13/02* (2006.01)

(52) U.S. Cl.
CPC ..... *G10D 13/023* (2013.01); *G10D 13/028* (2013.01)

(58) Field of Classification Search
CPC ..... G10D 13/028; G10D 13/00
See application file for complete search history.

(56) References Cited

U.S. PATENT DOCUMENTS 7,888,574 B1 * 2/2011 Acoutin ..... G10D 13/02 84/411 R
8,093,477 B1 * 1/2012 Twyford ..... G10D 13/08 84/411 R

* cited by examiner

*Primary Examiner* — Kimberly Lockett
(74) *Attorney, Agent, or Firm* — Dale Jensen, PLC; Dale Jensen

(57) ABSTRACT

Certain exemplary embodiments can provide a percussion instrument comprising a wood upper section, a stone core, a wood lower section, and a plurality of lug bodies. The wood upper section is coupled to the wood lower via the plurality of lug bodies. Each of the plurality lug bodies restrains the wood upper section from moving relative to the wood lower section. The stone core is held in position by the wood upper section and the wood lower section.

4 Claims, 2 Drawing Sheets

SYSTEMS, DEVICES, AND/OR METHODS FOR PERCUSSION INSTRUMENTS

CROSS-REFERENCES TO RELATED APPLICATIONS

This application claims priority to, and incorporates by reference herein in its entirety, pending U.S. Provisional Patent Application Ser. No. 62/406,904, filed Oct. 11, 2016.

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Certain exemplary embodiments can provide a percussion instrument comprising a wood upper section, a stone core, a wood lower section, and a plurality of lug bodies. The wood upper section is coupled to the wood lower via the plurality of lug bodies. Each of the plurality lug bodies restrains the wood upper section from moving relative to the wood lower section. The stone core is held in position by the wood upper section and the wood lower section.

Certain exemplary embodiments provide for an improved percussion instrument. Experiments with different stone and wood compositions for drum shells have been performed. The experiments resulted in the design of a stone core with interlocking wood sections. Certain exemplary embodiments do not use adhesives.

Figure 1:
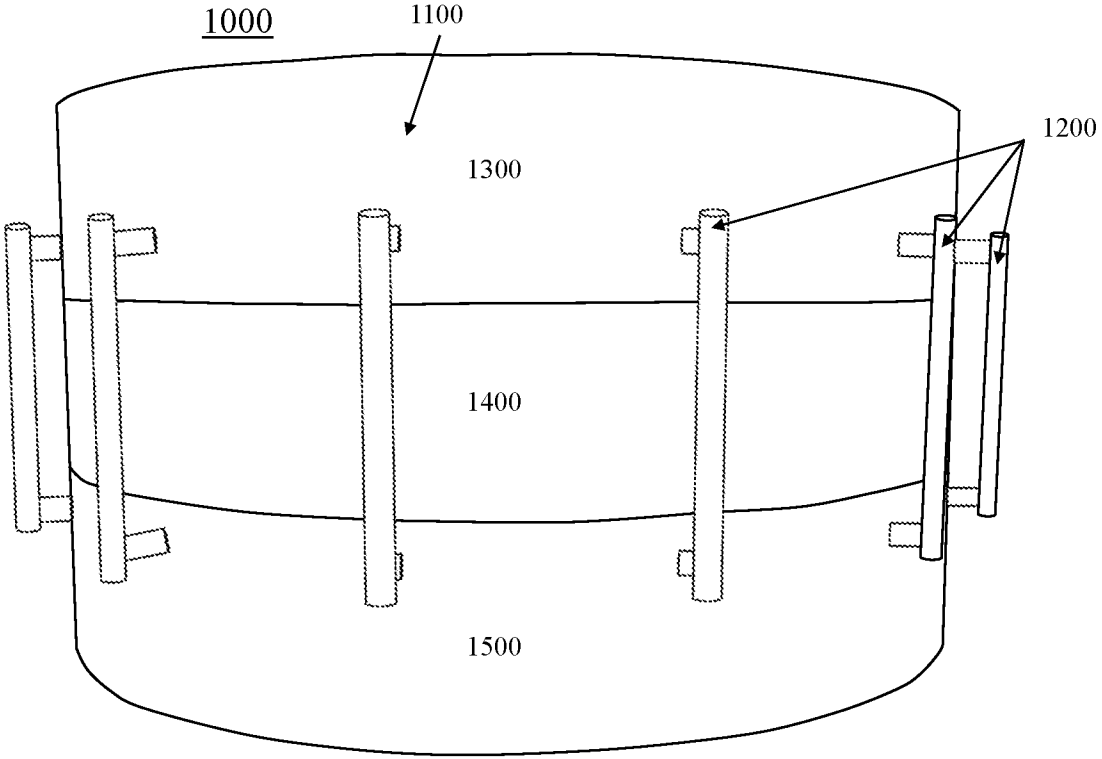
FIG. 1 is a side view of an exemplary embodiment of a system 1000.

FIG. 1 is a side view of an exemplary embodiment of a system 1000, which comprises a stone core drum shell 1100. Stone core drum shell 1100 comprises a plurality of sections coupled via a plurality of lug bodies 1200. Each of plurality of lug bodies 1200 affixes wood upper section 1300, stone core 1400, and wood lower section 1500. Plurality of lug bodies 1200 can be directly coupled to wood upper section 1300 and wood lower section 1500 via fasteners. The fasteners can pass through apertures defined by wood upper section 1300 and wood lower section 1500.

Wood upper section 1300 and/or wood lower section 1500 can comprise any of a variety of woods selected for sound quality. For example, wood upper section 1300 and/or wood lower section 1500 can comprise maple, birch, and/or luan wood, etc.

Certain exemplary embodiments provide a percussion instrument comprising:

- wood upper section 1300;
- stone core 1400;
- wood lower section 1500;
- plurality of lug bodies 1200, wherein wood upper section 1300 is coupled to wood lower section 1500 the plurality of lug bodies 1200, each of plurality lug bodies 1200 restrains wood upper section 1300 from moving relative to wood lower section 1500, wherein stone core 1400 is held in position by wood upper section 1300 and wood lower section 1500; and

- a plurality of fasteners that couple plurality of lug bodies 1200 to wood upper section 1300 and wood lower section 1500.

In certain exemplary embodiments provide a percussion instrument wherein:

- stone core 1400 is substantially cylindrical with a chamfered upper surface (see chamfered upper surface 2620 of FIG. 2) and a chamfered lower surface (see chamfered lower surface 2640 of FIG. 2);
- wood upper section 1300 is substantially cylindrical with a wood upper section chamfered surface (see wood upper section chamfered surface 2600 of FIG. 2) that engages with, and substantially matches, chamfered upper surface (see chamfered upper surface 2620 of FIG. 2) of stone core 2400; and
- wood lower section 1500 is substantially cylindrical with a wood lower section chamfered surface (see wood lower section chamfered surface 2660 of FIG. 2) that engages with, and substantially matches, chamfered lower surface (see chamfered lower surface 2640 of FIG. 2) of stone core 1400.

Certain exemplary embodiments provide a percussion instrument comprising:

- wood upper section 1300, wherein wood upper section 1300 substantially cylindrical with a wood upper section chamfered surface (see wood upper section chamfered surface 2600 of FIG. 2);
- wood lower section 1500, is substantially cylindrical with a wood lower section chamfered surface (see wood lower section chamfered surface 2660 of FIG. 2);
- stone core 1400, wherein stone core 1400 is substantially cylindrical with a chamfered upper surface (see chamfered upper surface 2620 of FIG. 2) and a chamfered lower surface(see chamfered lower surface 2640 of FIG. 2), the chamfered upper surface of the stone core substantially matching and engaging with the wood upper section chamfered surface, the chamfered lower surface of the stone core substantially matching and engaging with the wood lower section chamfered surface;
- plurality of lug bodies 1200, wherein wood upper section 1300 is coupled to wood lower section 1500 via plurality of lug bodies 1200, each of plurality lug bodies 1200 restrains wood upper section 1300 from moving relative to wood lower section 1500, wherein stone core 1400 is held in position by wood upper section 1300 and wood lower section 1500; and
- a plurality of fasteners that couple plurality of lug bodies 1200 to wood upper section 1300 and wood lower section 1500.

Figure 2:
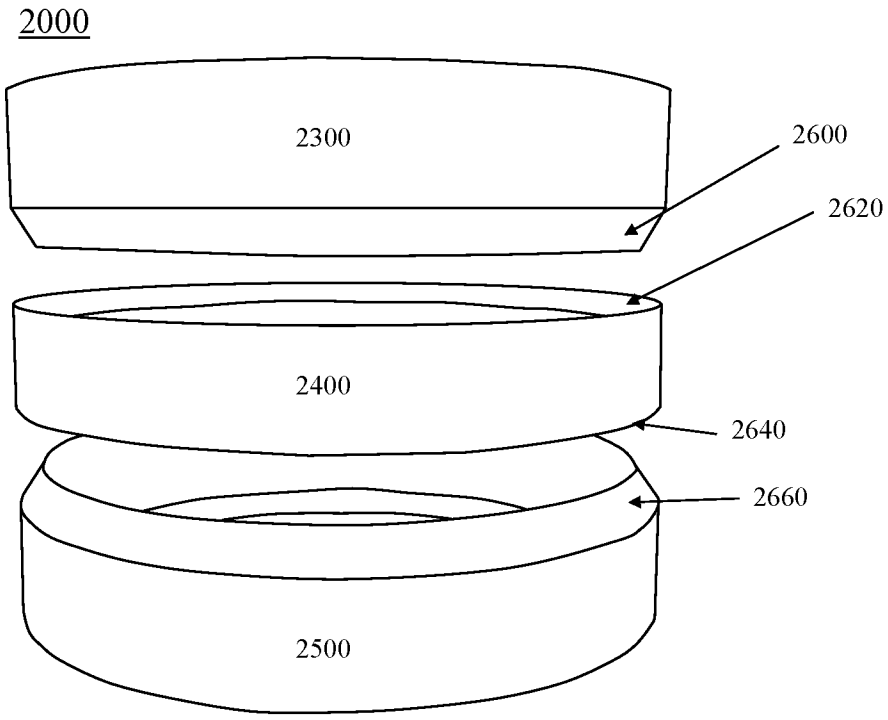
FIG. 2 is an exploded view of an exemplary embodiment of system 2000.

FIG. 2 is an exploded view of an exemplary embodiment of system 2000, which is similar to system 1000 of FIG. 1 except not coupled via plurality of lug bodies 1200. Wood upper section 2300 defines a wood upper section chamfered surface 2600. Stone core 2400 defines a chamfered upper surface 2620 and a chamfered lower surface 2640. Wood lower section 2500 defines a wood lower section chamfered surface 2660. Each of wood upper section chamfered surface 2600, stone core chamfered upper surface 2620, stone core chamfered lower surface 2640, and wood lower section chamfered surface 2660 can be chamfered at approximately 45 degrees such that each can interlock to engage wood upper section 2300, stone core 2400, and wood lower section 2500. Other chamfer angles (e.g., approximately 60 degrees for the stone core and approximately 30 degrees for the wood sections can be used so long as they substantially fully engage with opposing surfaces.

The illustrated embodiment of system 2000 shows heights of wood upper section 2300, stone core 2400, and wood lower section 2500 as approximately equal. In other embodiments the heights of each of wood upper section 2300, stone core 2400, and wood lower section 2500 can have alternate heights relative to each other. For example, stone core 2400 can have a height approximately double a height of each of wood upper section 2300 and wood lower section 2500. Heights can be adjusted to achieve a desired tone from the percussion instrument. In certain exemplary embodiments, stone core 1400 can comprise and/or be substantially pure quartz, quartz crystal, quartz and resin, and/or any of a wide variety of gemstones. Gemstones can comprise, for example, amethyst, citrine, turquoise, blue topaz, peridot, jade, garnet, tourmaline, moonstone, malachite, jasper, rose quartz, tanzanite, opal, pearl black onyx, aquamarine, and/or topaz, etc.

Certain exemplary embodiments can be utilized for acoustic snare drums and/or drum sets, etc.

Definitions

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.
activity—an action, act, step, and/or process or portion thereof
adapter—a device used to effect operative compatibility between different parts of one or more pieces of an apparatus or system.
and/or—either in conjunction with or in alternative to.
aperture—a hole or opening in something.
apparatus—an appliance or device for a particular purpose
associate—to join, connect together, and/or relate.
body—a main portion of a physical object.
can—is capable of, in at least some embodiments.
cause—to produce an effect.
chamfered—having an edge of a structure that is substantially not perpendicular to the faces of the piece.
comprising—including but not limited to.
configure—to make suitable or fit for a specific use or situation.
connect—to join or fasten together.
constructed to—made to and/or designed to.
convert—to transform, adapt, and/or change.
core—a central part of a device and/or system.
coupleable—capable of being joined, connected, and/or linked together.
coupling—linking in some fashion.
create—to bring into being.
cylindrical—is a shape defined by a surface formed by the points at a fixed distance from a given straight line called the axis of the cylinder.
define—to establish the outline, form, or structure of
determine—to obtain, calculate, decide, deduce, and/or ascertain.
device—a machine, manufacture, and/or collection thereof.
engage with—to interlock with.
fastener—a hardware device that mechanically joins or affixes two or more objects together.
hold—to fix something in position.
install—to connect or set in position and prepare for use.
instrument—a device and/or system used to create music.
lower—nearer to a bottom of a device and/or system when the device and/or system is oriented in its designed operative position.
lug—a projecting piece by which components of a percussion instrument are coupled.
match—to fit together.
may—is allowed and/or permitted to, in at least some embodiments.
method—a process, procedure, and/or collection of related activities for accomplishing something.
move—to reposition relative to something else.
percussion instrument—a device or system that makes musical sounds via being struck or scraped by an object (including attached or enclosed beaters or rattles); struck, scraped or rubbed by hand; or struck against another similar instrument.
plurality—the state of being plural and/or more than one.
position—a location relative to something else.
predetermined—established in advance.
provide—to furnish, supply, give, and/or make available.
receive—to get as a signal, take, acquire, and/or obtain.
relative—in comparison to something else.
repeatedly—again and again; repetitively.
restrain—to resist motion of something relative to something else.
section—a subpart of a device and/or system.
set—a related plurality.
shell—an outer casing of a percussion instrument.
stone—a piece of rock shaped for a purpose.
substantially—to a great extent or degree.
support—to bear the weight of, especially from below.
system—a collection of mechanisms, devices, machines, articles of manufacture, processes, data, and/or instructions, the collection designed to perform one or more specific functions.
upper—nearer to a top of a device and/or system when the device and/or system is oriented in its designed operative position.
via—by way of and/or utilizing.
wood—the hard fibrous material that forms the main substance of the trunk or branches of a tree.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;

no characteristic, function, activity, or element is "essential";

any elements can be integrated, segregated, and/or duplicated;

any activity can be repeated, any activity can be performed by multiple entities, and/or any activity can be performed in multiple jurisdictions; and any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A percussion instrument comprising:

a wood upper section;

a stone core;

a wood lower section; and a plurality of lug bodies, the wood upper section is coupled to the wood lower section via the plurality of lug bodies, each of the plurality lug bodies restraining the wood upper section from moving relative to the wood lower section, the stone core held in position by the wood upper section and the wood lower section.

2. The percussion instrument of claim 1, wherein:

the stone core is substantially cylindrical with a chamfered upper surface and a chamfered lower surface;

the wood upper section is substantially cylindrical with a wood upper section chamfered surface that engages with, and substantially matches, chamfered upper surface of the stone core; and the wood lower section is substantially cylindrical with a wood lower section chamfered surface that engages with, and substantially matches, chamfered lower surface of the stone core.

3. The percussion instrument of claim 1, further comprising:

a plurality of fasteners that couple the plurality of lug bodies to the wood upper section and the wood lower section.

4. A percussion instrument comprising:

a wood upper section, the wood upper section substantially cylindrical with a wood upper section chamfered surface;

a wood lower section, is substantially cylindrical with a wood lower section chamfered surface;

a stone core, the stone core substantially cylindrical with a chamfered upper surface and a chamfered lower surface, the chamfered upper surface of the stone core substantially matching and engaging with the wood upper section chamfered surface, the chamfered lower surface of the stone core substantially matching and engaging with the wood lower section chamfered surface;

a plurality of lug bodies, the wood upper section is coupled to the wood lower section via the plurality of lug bodies, each of the plurality lug bodies restraining the wood upper section from moving relative to the wood lower section, the stone core held in position by the wood upper section and the wood lower section; and a plurality of fasteners that couple the plurality of lug bodies to the wood upper section and the wood lower section.

* * * * *